US006758572B2

(12) United States Patent
Ladyjensky

(10) Patent No.: US 6,758,572 B2
(45) Date of Patent: Jul. 6, 2004

(54) CHEMILUMINESCENT LIGHTING ELEMENT

(75) Inventor: Jacques Ladyjensky, Brussels (BE)

(73) Assignee: Omniglow Corporation, Novato, CA (US)

( * ) Notice: Subject to any disclaimer, the term of this patent is extended or adjusted under 35 U.S.C. 154(b) by 117 days.

(21) Appl. No.: 09/948,386

(22) Filed: Sep. 7, 2001

(65) Prior Publication Data

US 2003/0048631 A1 Mar. 13, 2003

Related U.S. Application Data

(63) Continuation-in-part of application No. 09/914,513, filed as application No. PCT/BE01/00040 on Mar. 8, 2001.

(30) Foreign Application Priority Data

Mar. 1, 2000 (BE) ..... 0000195

(51) Int. Cl.[7] ..... F21K 2/00
(52) U.S. Cl. ..... 362/34; 362/812; 40/542
(58) Field of Search ..... 362/34, 84, 812; 40/542

(56) References Cited

U.S. PATENT DOCUMENTS 3,539,794 A 11/1970 Rauhut et al.
3,576,987 A 5/1971 Ridgefield et al.
3,584,211 A * 6/1971 Rauhut ..... 362/34
3,638,786 A 2/1972 Borecki et al.
3,720,823 A 3/1973 Black et al.
3,764,796 A 10/1973 Gilliam et al.
3,816,325 A 6/1974 Rauhut et al.
3,847,279 A 11/1974 Montgomery
4,193,109 A 3/1980 Heffernan et al. ..... 362/34
4,635,166 A 1/1987 Cameron ..... 362/34
4,682,544 A 7/1987 Koroscil et al.
4,751,616 A 6/1988 Smithey ..... 362/34
4,814,949 A 3/1989 Elliott ..... 362/34
5,121,302 A 6/1992 Bay et al. ..... 362/34
5,226,710 A * 7/1993 Giglia et al. ..... 362/34
5,458,244 A 10/1995 Emori

* cited by examiner

*Primary Examiner*—Stephen Husar
(74) *Attorney, Agent, or Firm*—McHale & Slavin, P.A.

(57) ABSTRACT

The invention relates to a chemiluminescent light element having at least two chambers, filled with an oxalate solution and an activator solution, or variations of known chemiluminescent light materials including dyes. The oxalate solution is placed within a tight-sealed pouch made of thin aluminum foil lined on its interior side by a polymer, for instance a polyolefin, and so forms the first chamber. This latter is enclosed in a bigger tight-sealed pouch made of translucent polymer film forming the second chamber, which also contains the liquid activator. The outer pouch consists of two polymer films sealed together along their periphery and contain a ball able to pierce the inner pouch by manual action from the user.

8 Claims, 5 Drawing Sheets

80

85

CHEMILUMINESCENT LIGHTING ELEMENT

CROSS-REFERENCE TO RELATED APPLICATIONS

This application is a continuation-in-part of applicant's co-pending U.S. application Ser. No. 09/914,513 filed Aug. 28, 2001, which is based on related Belgian Patent Application 2000/0195 dated Mar. 1, 2000 and which is a 371 of PCT Application PCT/BE 01/00040 dated Mar. 8, 2001, the contents of which are incorporated herein.

BACKGROUND

Devices able to emit light by the mixing of two liquid chemicals are well known. Such devices are disclosed in the following U.S. Pat. Nos. 3,539,794; 3,576,987; 4,193,109; 4,682,544; 4,751,616; 4,814,949 and 5,121,302.

Generally speaking the proposed devices involve two chambers, respectively containing the first liquid chemical, named oxalate solution, and the second one, named activator solution. These two chambers are separated by a wall which can be broken by the user, or which may have a removable part. Said wall should also be a good barrier against gases, because the oxalate solution is sensitive to any contamination originating either from outside or from the activator. Therefore, in practice, save economically costly exceptions, the oxalate solution is enclosed in a breakable glass ampule. Unfortunately, it is not possible to continuously manufacture, starting from material in roll form, elements with glass ampules. Moreover, they are expensive.

SUMMARY OF THE INVENTION

The present invention relates to an element useful for such a continuous manufacture, thus very economical, and what is more, with inexpensive constitutive materials. The element has furthermore the advantage of being flat, of being particularly light, as well as other auxiliary advantages which will appear in the following disclosure.

More particularly, the invention proposes a chemiluminescent lighting element involving at least two chambers filled respectively with an oxalate solution and an activator solution. The oxalate solution is in a tight-closed pouch of thin aluminum foil, lined on its interior side by a polymer, said pouch being a first chamber. This pouch is itself enclosed in a bigger tight-closed pouch, made of translucent polymeric film, being a second chamber, which also contains the liquid activator chemical.

The element according to the invention is then essentially comprising a pouch made of aluminum foil containing the oxalate solution, disposed inside a pouch made of translucent plastic film, containing also the activator solution, and, optionally, an absorbing felt and a steel ball or other hard particle, of which the role is to pierce the aluminum pouch at the moment of use, under the effect of manipulation by the user.

In the basic invention under reference, the chemiluminescent reaction giving the emission of light, is accompanied, right from the starting moment when the components are mixed, by a gaseous emission which leads to a swelling or inflation of the outer pouch in translucent film. In certain cases, this inflation is useful for giving the luminous item a tridimensional form, for instance, the form of a flower. Before the starting of the reaction, i.e., during the storage and until the moment of activation by the customer, and including it, the outer pouch remains flat, as well as the one inside, and the customer cannot realize what will be the form in relief to be adopted by the item once lighted up. It has been found that it is possible to obtain a certain gas emission during the storage period, and thus also at the moment of the selling operation in having one of the components, not in one of the aluminum pouches, but aside of those. It is namely the case of certain oxalate esters associated to certain solvents, of which it has been found that they give a slight gas emission during storage, what they do not do when in an aluminum pouch.

An objective of the invention is to teach the use of a flexible pouch housing a flexible and burstable inner pouch to allow admixing of an activator and oxalate for chemiluminescent light.

An advantage of the instant invention is obtained when the activator solution, instead of being put in one single pouch, and without modifying its total amount, is put by halves in two distinct pouches. The end user will light up the element starting with one of these pouches, using the second one at the moment where he wants to regenerate the light emission.

A further advantage of the proposed combinations is obtained with the following embodiment. The activator is put in a single pouch, but under the form of a solid solution. Once the various pouches pierced (including this one cited), the pouch with solid activator receives some liquid coming from the other one(s), which are to slowly and progressively dissolve its contents. The light emission therefore is progressively regulated in the same rate, which can be predetermined by judicious dosings.

A further advantage, analogous, can also be obtained with a solid solution of the oxalate ester, in an appropriate pouch, and a liquid solution for the activator, in order to get here too, a progressive dissolving. Referring to this, one can use of a process allowing to obtain solid solutions of oxalate esters, as described in U.S. Pat. No. 3,816,325 for instance.

A further obtainable advantage, with another configuration, can be the following one. Among the ingredients are one or several dyes. One can put one dye separately in one aluminum foil pouch, let us say for instance; a blue dye, and another one, let us say for instance red, in another separate pouch. The two pouches with dyes are well marked to easily recognizable by the user, which begins with piercing the blue one only. Later, for instance at a given signal, the user or users are invited to pierce the red pouch and obtain then a pink emission suddenly instead of a blue one. This can be appreciated in the amusement field, where the present kind of chemiluminescent lighting elements are frequently of use.

A method of manufacturing a plurality of chemiluminescent lighting elements in a continuous process includes the steps of providing first and second sheets of aluminum foil each having a heat-sealing coating, juxtapositioning the first and second sheets of aluminum foil with the heat-sealing coatings in contact, heat-sealing the first and second sheets of aluminum foil along a first periphery to form a first interior chamber with a portion of said first periphery forming an opening, filling the first interior chamber through the opening with a first part of a two-part chemiluminescent light producing mixture, heat-sealing the opening for maintaining the first part of a two-part chemiluminescent light producing mixture therein to create a filled inner pouch, cutting the first and second sheets of aluminum foil proximate to the first periphery to separate the inner pouch with an automatic knife, positioning the inner pouch between first and second sheets of flexible plastic, heat sealing the first and second sheets of flexible plastic along a second periphery to form a second interior chamber capturing the inner pouch therein with a portion of said second periphery forming an opening, filling the second interior chamber through the opening with a second part of a two-part chemiluminescent light producing mixture, and sealing the opening to create an outer pouch containing the second part of a two-part chemiluminescent light producing mixture and the inner pouch therein. A hard particle, such as a ball bearing, can be inserted between the inner and outer pouches.

The manufacturing process of the invention can further include the step of providing a sheet of fiber felt between the first and second first sheets of flexible plastic, and sealing the first and second sheets of flexible plastic and the sheet of fiber felt along the second periphery to form the second interior chamber.

In the practice of the method of the invention, the sheet materials are dispensed from continuous rolls so that the inner pouches are incorporated into the outer pouches in a continuous process.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

BRIEF DESCRIPTION OF THE DRAWINGS

The invention will be better understood with reference to the annexed drawings, shown as examples. In these drawings.

DETAILED DESCRIPTION

Figure 1:
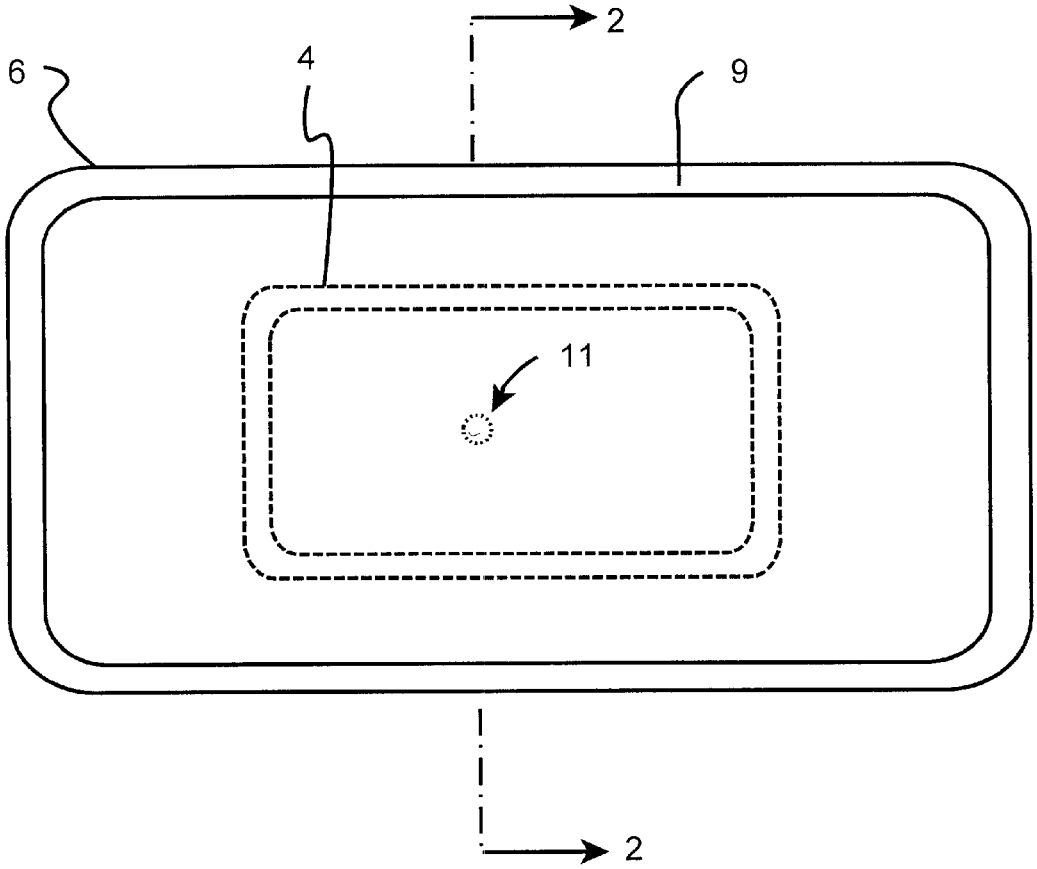
FIG. 1 represents a top plan view of the device according to the invention.
Figure 2:
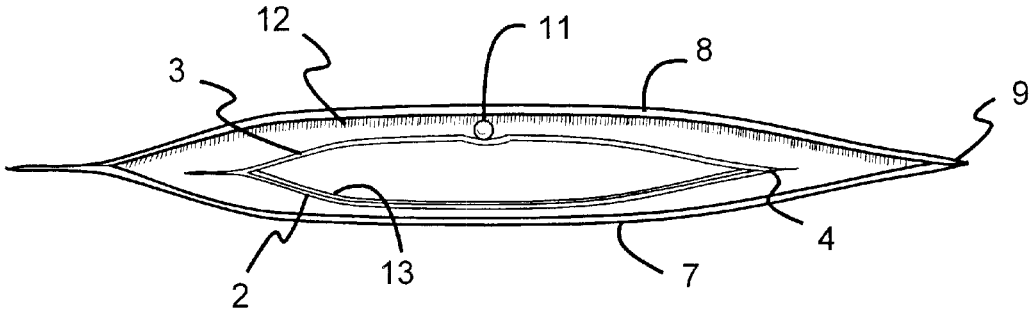
FIG. 2 is a cross-sectional view of same.
Figure 3:
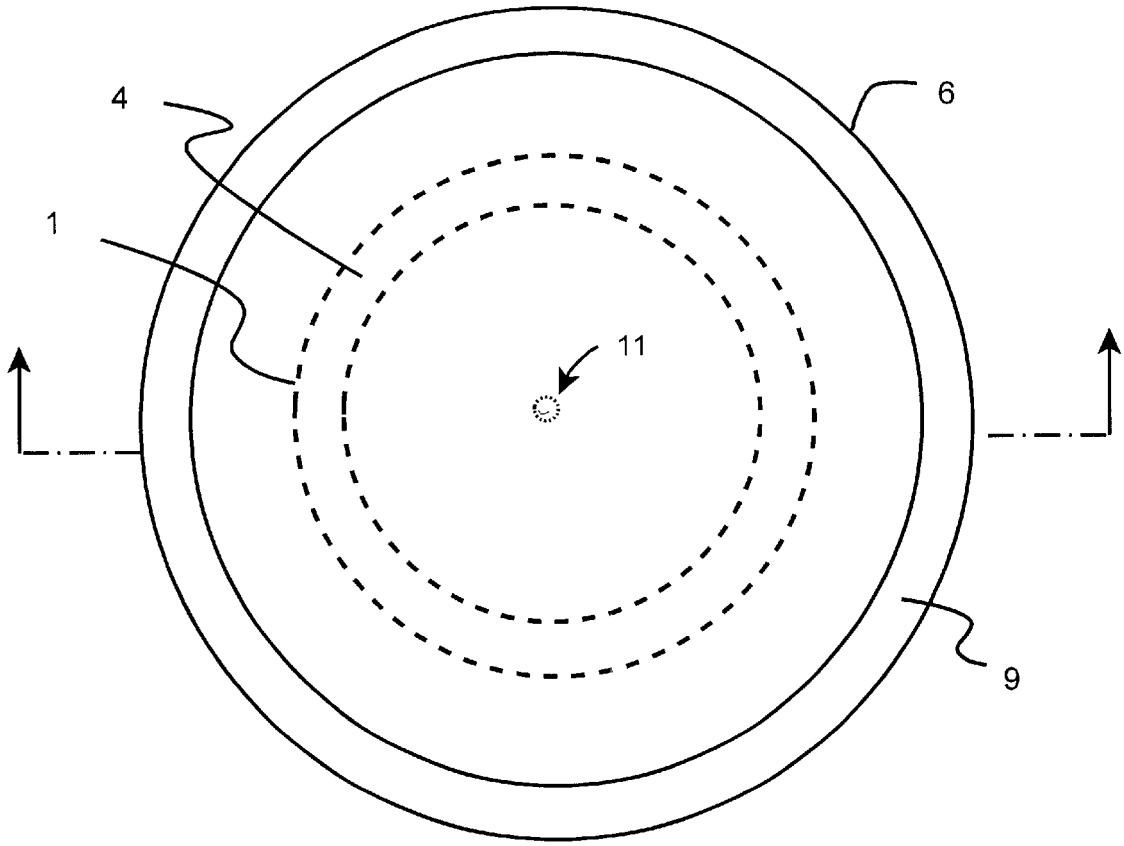
FIG. 3 is a top plan view of another embodiment of the invention.
Figure 4:
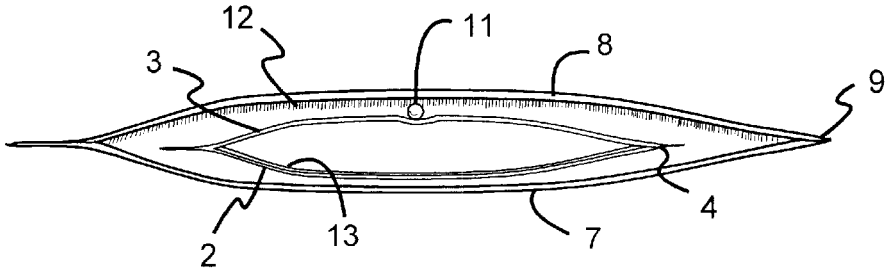
FIG. 4 is its matching cross-sectional view.

The inner pouch 1 is made of the two aluminum foils 2 and 3, sealed together along their periphery 4, rectangular in FIGS. 1 and 2, and circular in FIGS. 3 and 4. The inner pouch 1 can also be formed from a single sheet of aluminum foil which is folded in half and sealed along the periphery.

The inner pouch 1 contains an oxalate liquid chemical solution. The outer pouch 6 can be made of two films 7 and 8, of translucent soft polymer, preferably polyolefin, for instance polyethylene or polypropylene, sealed along a periphery 9, rectangular in FIGS. 1 and 2, and circular in FIGS. 3 and 4. The outer pouch 6 contains an activator liquid. The outer pouch can also be formed from a single sheet of film which is folded in half and sealed along the periphery.

The device involves, optionally, a steel ball 11 or a hard particle on which the user will push in order to pierce the aluminum pouch, and so induce the mixing process. It can also be conceived, that this ball or particle be not used, and that the pouch will be bursted by pressure. In that case, it is suitable to foresee an area of weakened resistance, for instance a welding line. Each of the two aluminum foils is lined, by coating, laminating, or other technique, by a coat of polymeric lacquer, on this one of their surfaces which is to be faced to the corresponding one. This lacquer coat, preferably based on a polypropylene, modified or not, is provided to ensure the adhesion of the two foils together by thermal sealing along their periphery. This coat is not represented on the drawings for reasons of clarity.

This polymeric coat, in addition to adhesion, has also the role of insuring a good compatibility between aluminum material and the oxalate solution which is delicate and sensitive to contaminations, and is compatible with only few materials. This coat is very thin, in order not to increase the mechanical resistance of the aluminum, which is due to become broken.

In addition to this coat, it is possible to also foresee the presence of a thin soft film of polypropylene 13 between the two aluminum foils. It will be prisoner between them by the sealing and will contribute to the quality of said sealing. It is not represented on the drawings, for reasons of clarity. Of course the oxalate solution will be between this soft film and one of the aluminum foils, the one to be pierced.

The device involves also, optionally, a felt 12 (succession of small crosses on the drawings) made of nonwoven material of which the fibers are preferably from the same polymer as the films of the outer pouch. It will be prisoner between the two films by the peripheral thermal sealing. During the storage of the lighting element before use, this felt will have time to absorb the whole of the activator liquid and spread it uniformly in the pouch. The result will be a good uniformity in emitted light after the liberation of the oxalate solution, because the two chemical liquids are avid to diffuse into each other within a short time. The level of activator liquid is the one met at the time of filing; later, it will be absorbed in the felt as said above.

Once emptied, or almost emptied, the aluminum pouch remains in place and has a role of reflector; the whole of luminous emission takes place indeed from the same side of the aluminum pouch,—the pierced side. There is almost no liquid at the other side. This intense unidirectional emission of light is incontestably an advantage towards prior art in the matter.

It is frequent that the inner pouch be not entirely emptied by the user at the time of lighting-up. It has been seen that some rests were remaining inside because of some creases or other reasons. It is then advantageous, while the light is weakening with the hours, due to the unavoidable chemical energy consumption of the system, to handle the element with some kneading action, in order to extract the remains of oxalate solution contents out of the inner pouch. One can then see a kind of regeneration of the luminous emission, and this, at the moment decided by the user. This is an appreciable advantage versus the prior art, vainly asked for, until now, by the market.

In FIGS. 1 and 2 the element is figured under a rectangle form, and in FIGS. 3 and 4, under a circular form, but of course the peripheral sealing can have any other form, and, particularly, for advertising or promotional purposes, be made under the form of a brand logo.

Figure 5:
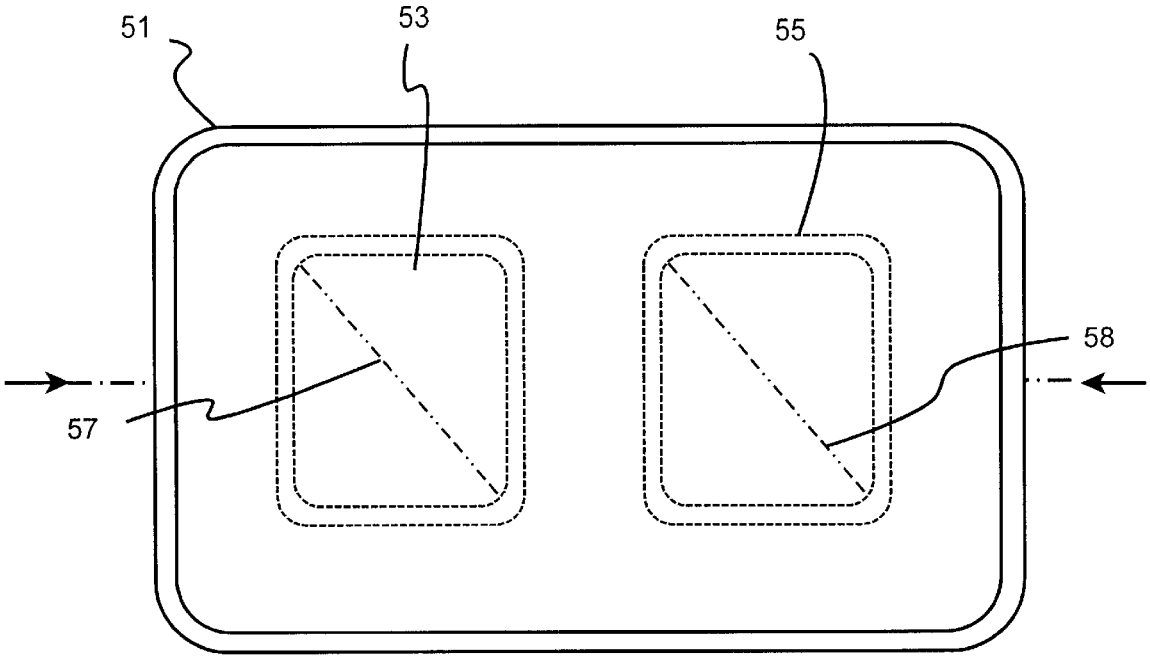
FIG. 5 is a top plan view of an alternative embodiment of the device including two inner pouches.
Figure 6:
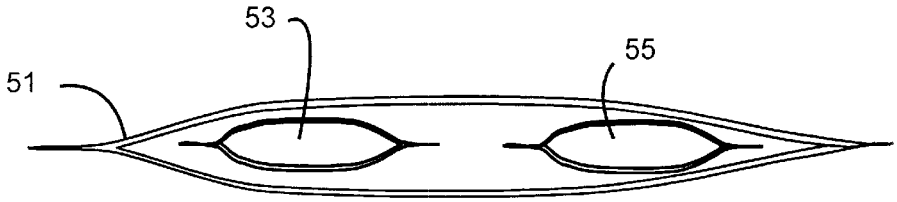
FIG. 6 is a cross section view of the device of FIG. 5 taken along the line 6—6.

FIGS. 5 and 6 illustrate another embodiment of the present invention in which two inner pouches 53 and 55 are disposed in an outer pouch 51. While two inner pouches are illustrated, the invention is not limited in this regard as any number of inner pouches may be included. The inner pouches 53 and 55 and outer pouch 51 can be constructed in the same manner as described fro the embodiments shown in FIGS. 1–4. The inner pouches 53 and 55 can contain two identical activators, or activators having different colored dyes. It may also be advantageous to separate the dye from the oxalate solution into separate inner pouches due to the fact that the dyes can cause the oxalate solution to breakdown.

In the illustrated embodiment, the inner pouches 53 and 55 respectively include frangible seams 57 and 58. The frangible seams 57 and 58 allow the inner pouches 53 and 55 to be ruptured by manual manipulation. As discussed above, a steel ball or other hard object can be used to burst the inner pouches 53 and 55.

For industrial manufacture, it is foreseen, with use of a "fill-and-seal" type of packaging machine, to unroll, from their respective storage rolls, the two aluminum foils, as well, if any, the optional roll of soft polymer film, in order to present face to face the coated sides of these aluminum foils, and to seal successively the pouches in a continuous and temporized way.

When the aluminum foils are face to face, one of them—or both—is slightly embossed by a small punching tool, mechanically actuated, this in view of creating a reservoir to receive the liquid. Then the injection of oxalate solution is done, followed by the pouch sealing. Once sealed, the pouches are separated by means of an automated knife, and fall individually into the second machine, described hereafter.

The machine can be of a vertical or horizontal type. The embossing operation is easier in horizontal machine and can be done on the inferior foil only.

The aluminum foils have been coated or laminated with the polymeric lacquer mentioned hereabove, in the course of a previous operation, which has also been done continuously by known means.

A second machine, also of the "fill-and-seal" type, receives in a sequential way, synchronously with the first machine, the filled and sealed aluminum pouches, and seals together the two soft plastic films, as well as the felt if any, all three of them being continuously unrolled from their storage rolls. Before sealing, a measured quantity of activator liquid is introduced, as well as the ball.

It is important to note that in this second machine, which manufactures the outer pouches (and this, contrarily to what happens in the first machine with the aluminum foils) the two films of flexible plastic, unrolled in view of the operation, remain flat, i.e. not "embossed" or "deep drawn" until the moment of final sealing. They then take a slightly swollen structure because at the sealing time, they cage between them the aluminum pouch. This swelling is a purely elastic deformation, with tensioning, due to the natural elasticity of the films, by nature reversible. As a result the walls of the outer pouch exert on the inner pouch and its contents, an uniform elastic pressure of which the action is very favorable at the moment of piercing by the user. The oxalate liquid is then ejected with force, which favors the desired mixing.

Figure 7:
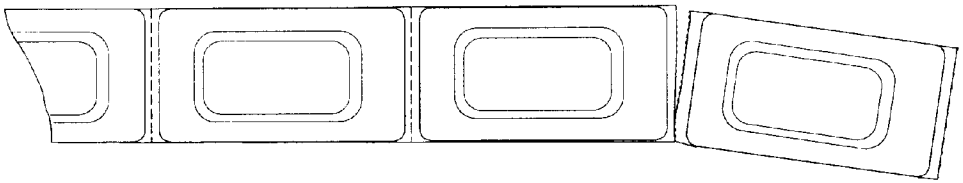
FIG. 7 illustrates the chain of lighting elements according to the method of the invention.
Figure 8:
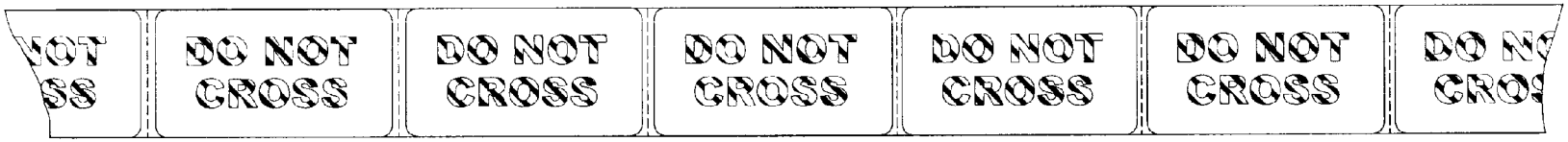
FIG. 8 illustrates an alternative embodiment of the invention.

The completed pouches then go out from the exit of the machine under the form of a chain 80, or sausage chain, as shown in FIG. 7. The individual light elements can be separated from each other by means of an automated knife, or by weakened lines, perforated or precut lines for ulterior separation by the user himself. The light units can be supplied in chain form to the user if he is interested by light "in-line",—a novel item being of interest for instance for police or army forces, as illustrated by the light chain 85 shown in FIG. 8.

EXAMPLES OF EMBODIMENTS

Example 1

In this example, it is made use of a vertical machine, of modified "fill-and-seal" type. The used aluminum foil is of Reynolds brand, in tape of 35 mm width, and 300 meter long rolls. Thickness is 28 micrometers for the face to be pierced and 38 micrometers for the other one.

Before being slit into rolls of 35 mm width, said foil has been coated on its full width 600 mm with polypropylene dispersion, and cured in a tunnel oven. The remaining deposited thickness after cure is 6 micrometer.

When the two aluminum foils are face to face, their mutual sealing is done along a rectangular periphery of 33×65 mm except on the upper side, through which an embossing finger mechanically penetrates accompanied with a needle for injection of the oxalate solution, then these two elements withdraw, and the sealing is completed.

The oxalate solution consists of a dibutylphthalate solvent in which, per liter, are dissolved 120 grams of CPP oxalate and 1.5 gram of DPEA dye. These components are well known in the prior art in matter of chemiluminescent elements.

The ball is a bearing ball, of third choice, diameter 4.5 mm.

The films in the outer pouch are of copolymer polypropylene-polyethylene without slip-agent in the formula, thickness 0.25 mm, in rolls of 40 mm width, 300 m length.

The measured quantities of oxalate solution and activator solution are respectively 1.7 and 0.7 milliliter.

Sealings are done by jaws or anvils having the shape of rectangles with rounded corners, with an effective sealing width of 2 mm. The thermal energy for the sealings is brought either by electrical resistance or via an ultrasonic generator.

The felt is a nonwoven "spunbond" film of polypropylene and polyethylene fibers, of 120 grams per square meter.

The completed items, separated by an automatic temporized knife, have a dimension of 45×70 mm and a weight of 4 grams.

Example 2

The process is same as in Example 1, but with use of an horizontal type machine. The embossing of the lower aluminum foil is done by lowering a punching tool prior to any sealing; then the depositing of the liquid chemical is done with a removable needle, thus the sealing between the two aluminum foils is done in one shot along the whole periphery.

In this case the aluminum tapes feeding the machine have a width of 41 mm, and those of flexible plastic film, a width of 65 mm. Quantities or oxalate solution and activator solution are respectively 2.2 and 1.1 milliliters. Completed items have a diameter of 59 mm and a weight of 5 grams.

Example 3

An outer pouch made of flexible translucent polymer film is provided, inside of which is a rather big pouch made of aluminum foil containing a liquid oxalate solution, and a rather small one containing an activator solution. The outer pouch also contains a ball, and a certain quantity of activator solution, put as such in said outer pouch. These elements are described as follows: Composition of the oxalate solution in its aluminum foil pouch: 0.4 gram solvent demthyl phthalate, 25 milligram oxygenated water at 85% vol., 100 milligram solvent t-butanol, 50 microgram sodium salicylate. Composition of the activator solution freely put in the outer pouch: idem. Ball: bearing ball third grade, 4 mm in diameter. Outer pouch: made of flexible film 0.2 mm thick of copolymer polypropylene-polyethylene, translucent, rectangular shape 80×50 mm, peripheric sealing by ultrasonic operation.

The biggest of the two aluminum foil pouches: 30 micrometer thick foil lacquered on the inside face with a themosealing lacquer, rectangular shape 40×40 mm, thermally sealed along its periphery.

The smallest of the two aluminum foil pouches, containing activator solution: same embodiment, dimension 35×30 mm.

At the moment of starting the lighting-up, the user will pierce firstly the big inner pouch. A first light emission takes place and lasts several hours, with a decrease. When the user judges it useful, he regenerates the light emission by piercing the small inner pouch. It is not necessary to place the two inner pouches in a predetermined fixed position, since they are quite visible and different from each other. The use of a single ball is sufficient, since its ability to roll where the user decides.

It has been seen that improvements in the quality of luminous emission are obtained when the individual components of the two solutions are contained separately in different pouches each made of aluminum foil.

In several cases, it is even not necessary to have as many balls as pouches: one single ball can pierce two or several pouches.

A first advantage is obtained under the form of an increase in light emission when, in certain case, one separates in distinct pouches the oxalate ester from its solvent and its associated dye. Absence of inhibiting interactions between components during the period of storage may provide increases in quality of light.

It has been made apparent that in certain cases, it was not necessary to do a complete segregation of all components, i.e., putting each of them in an individual pouch. According to the circumstances, one can have two of these, or even three, in the same pouch.

There are then several possible configurations among which is to be chosen the optimal one with given components. In the basic invention under reference, the chemiluminescent reaction giving the emission of light, is accompanied, right from the starting moment when the components are mixed, by a gaseous emission which leads to a swelling or inflation of the outer pouch in translucent film. In certain cases, this inflation is useful for giving the luminous item a tridimensional form, for instance, the form of a flower. The outer pouch is substantially flat in a first, non-inflated state and is configured to a have a non-planar form in a second, inflated state. The release of the liquid oxalate solution results in mixing with the liquid activator solution which provides a gaseous emission which inflates the outer pouch to the second inflated state. Before the starting of the reaction, i.e., during the storage and until the moment of the selling operation to the customer, and including it, the outer pouch remains flat, as well as the one inside, and the customer cannot realize what will be the form in relief to be adopted by the item once lighted up.

It has been found that it was possible to obtain a certain gas emission during the storage period,—and thus also at the moment of the selling operation—in having one of the components, not in one of the aluminum pouches, but aside of those. It is namely the case of certain oxalate esters associated to certain solvents, of which it has been found that they give a slight gas emission during storage, what they do not do when in an aluminum pouch.

Figure 9:
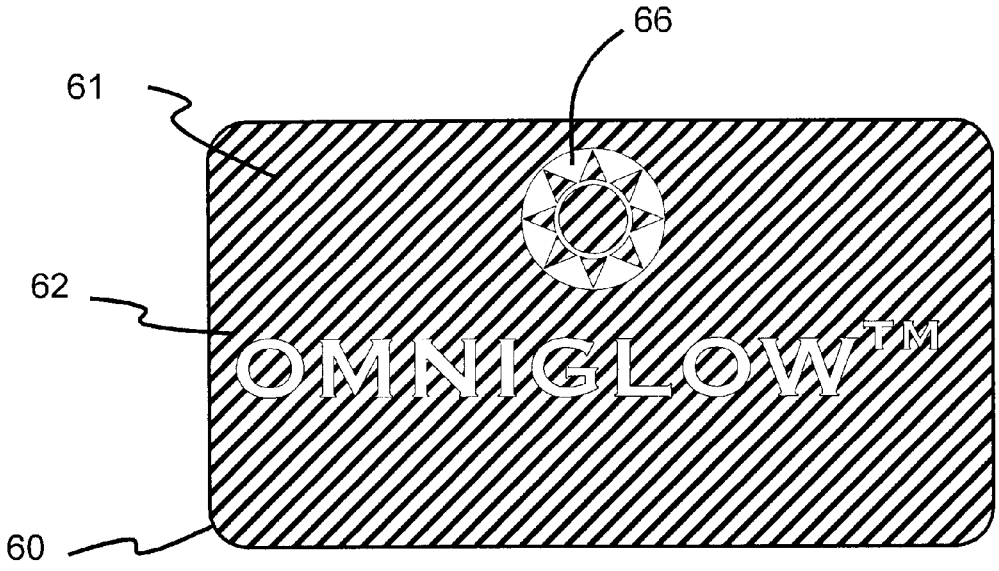
FIG. 9 illustrates the use of opaque masking material to define open areas to create indicia and other designs on the lighting elements.
Figure 10:
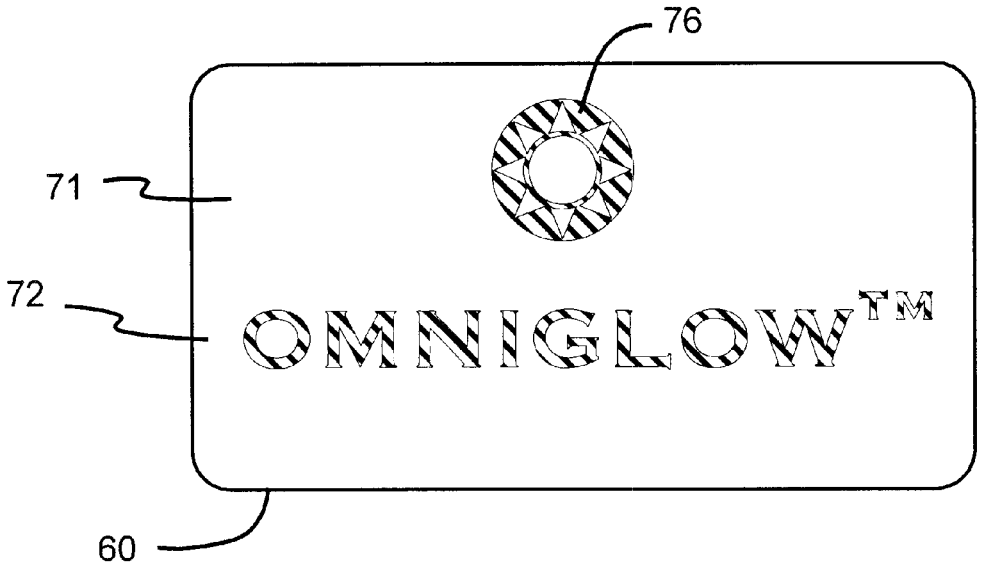
FIG. 10 illustrates the use of opaque masking material to form indicia and other designs on the lighting elements.

The outer pouch can also include opaque masking material forming indicia and other ornamental designs which are enhanced by light emission. In FIG. 9, the outer pouch 60 is substantially covered by an opaque material 61 which has open areas defining indicia 62 and decorative design 66. When the light emission process is activated, the indicia 62 and decorative design 66 are illuminated. In FIG. 10, the outer pouch 60 includes indicia 72 and decorative design 76 which are formed from opaque material and are thus highlighted when light emission is activated.

It is to be understood that while we have illustrated and described certain forms of the invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. A chemiluminescent lighting element comprising: at least one inner pouch formed from a continuous wall of opaque material defining an interior chamber for holding of a liquid oxalate solution; an outer pouch formed from a continuous wall of translucent material defining an interior chamber for holding of a liquid activator solution and said inner pouch; wherein release of said liquid oxalate solution results in mixing with said liquid activator solution provides a chemiluminescent light visible through said wall of said outer pouch, said outer pouch includes an inner surface liner along a portion of said wall, said liner formed from an absorbing material compatible with the oxalate and activator solutions, the periphery of said liner is sealed to said continuous wall of said outer pouch.

2. The chemiluminescent lighting element according to claim 1 wherein said absorbing material is a polymer fiber felt.

3. The chemiluminescent lighting element according to claim 1 wherein said continuous wall is formed from two superposed films having a sealed periphery, said films under elastic tension.

4. The chemiluminescent lighting element according to claim 1 wherein said liquid oxalate is selected from the group of: pure oxalate ester in solid form, oxalate ester in liquid solution, oxalate ester in solid solution, pure liquid solvent, activator solution in liquid form, and dyes.

5. The chemiluminescent lighting element according to claim 1 wherein said outer pouch includes indicia.

6. The chemiluminescent lighting element according to claim 1 wherein portions of said outer pouch are opaque.

7. A chemiluminescent lighting element comprising: at least one inner pouch formed from a continuous wall of opaque material defining an interior chamber for holding of a liquid oxalate solution; an outer pouch formed from a continuous wall of translucent material defining an interior chamber for holding of a liquid activator solution and said inner pouch; wherein release of said liquid oxalate solution results in mixing with said liquid activator solution provides a chemiluminescent light visible through said wall of said outer pouch, said outer pouch contains a hard material, said hard material is polyolefin granulates.

8. A method of manufacturing a plurality of chemiluminescent lighting elements in a continuous process comprising the steps of:

providing first and second sheets of aluminum foil each having a heat-sealing coating;

juxtapositioning the first and second sheets of aluminum foil with the heat-sealing coatings in contact;

heat-sealing the first and second sheets of aluminum foil along a first periphery to form a first interior chamber with a portion of said first periphery forming an opening;

filling the first interior chamber through the opening with a first part of a two-part chemiluminescent light producing mixture;

heat-sealing the opening for maintaining the first part of a two-part chemiluminescent light producing mixture therein to create a filled inner pouch;

cutting the first and second sheets of aluminum foil proximate to the first periphery to separate the inner pouch with an automatic knife;

positioning the inner pouch between first and second sheets of flexible plastic;

heat sealing the first and second sheets of flexible plastic along a second periphery to form a second interior chamber capturing the inner pouch therein with a portion of said second periphery forming an opening;

filling the second interior chamber through the opening with a second part of a two-part chemiluminescent light producing mixture;

sealing the opening to create an outer pouch containing the second part of a two-part chemiluminescent light producing mixture and the inner pouch therein, including the steps of:

dispensing the first and second sheets of aluminum foil from continuous rolls;

dispensing the first and second sheets of plastic from continuous rolls; and sequentially incorporating the inner pouches into the outer pouches in a continuous process.

* * * * *